United States Patent [19]

McMahon et al.

[11] 4,342,158

[45] Aug. 3, 1982

[54] BIOMECHANICALLY TUNED SHOE CONSTRUCTION

[76] Inventors: Thomas A. McMahon, 65 Crest Rd., Wellesley, Mass. 02181; Peter R. Greene, 77 Lanark Rd., Apt. 1, Brookline, Mass. 02146

[21] Appl. No.: 160,967

[22] Filed: Jun. 19, 1980

[51] Int. Cl.[3] ..... A43B 21/26; A43B 21/30

[52] U.S. Cl. ..... 36/35 R; 36/28; 36/35 B; 36/37; 36/38; 36/114

[58] Field of Search ..... 36/7.8, 28, 29, 35 R, 36/35 B, 36 R, 37, 38, 114, 129

[56] References Cited

U.S. PATENT DOCUMENTS

| | | | |
|---|---|---|---|
| 949,754 | 2/1910 | Busky | 36/35 B |
| 2,122,108 | 6/1938 | Modlin | 36/35 B |
| 3,041,746 | 7/1962 | Rakus | 36/36 R |
| 3,429,545 | 2/1969 | Michel | 36/38 |
| 4,267,648 | 5/1981 | Weisz | 36/28 |

FOREIGN PATENT DOCUMENTS

| | | | |
|---|---|---|---|
| 21594of | of 1902 | United Kingdom | 36/35 B |
| 2032761 | 5/1980 | United Kingdom | 36/35 B |

*Primary Examiner*—James Kee Chi

*Attorney, Agent, or Firm*—Kenway & Jenny

[57] ABSTRACT

A biochemically tuned shoe has a heel construction that provides a force-deflection response which is optimal for a particular person and a particular use. The heel construction features a main spring that is characterized by a large vertical compliance while at the same time exhibiting an extremely high resistance to a lateral shear (horizontal compliance). The main spring is preferably a coned disk spring formed of a plastic material or a vertical stack of operatively coupled coned disk springs. The main spring can be embedded in a conventionally shaped heel formed of a resilient material such as an open or closed cell foamed rubber or plastic secured to the sole of the shoe. In other forms, the heel construction is replaceably secured to the sole by a threaded stud with or without an intermediate assembly. In a preferred form, the main spring acts in cooperation with a resilient member to extend the characteristic load deflection curve of the main spring. The resilient member can be the foamed rubber or plastic heel material that embeds the main spring or a column of a highly resilient material such as a soft rubber located at the center of the coned disk main spring. The heel construction of this invention provides a vertical compliance, expressed as its inverse, a spring constant, of 3,000 to 25,000 lbf/ft. In terms of deflection, when used in an adult running shoe, the heel exhibits a maximum deflection of $\frac{1}{8}$ inch to $\frac{5}{8}$ inch at the peak applied load, typically 400 to 500 pounds of force (lbf).

59 Claims, 24 Drawing Figures

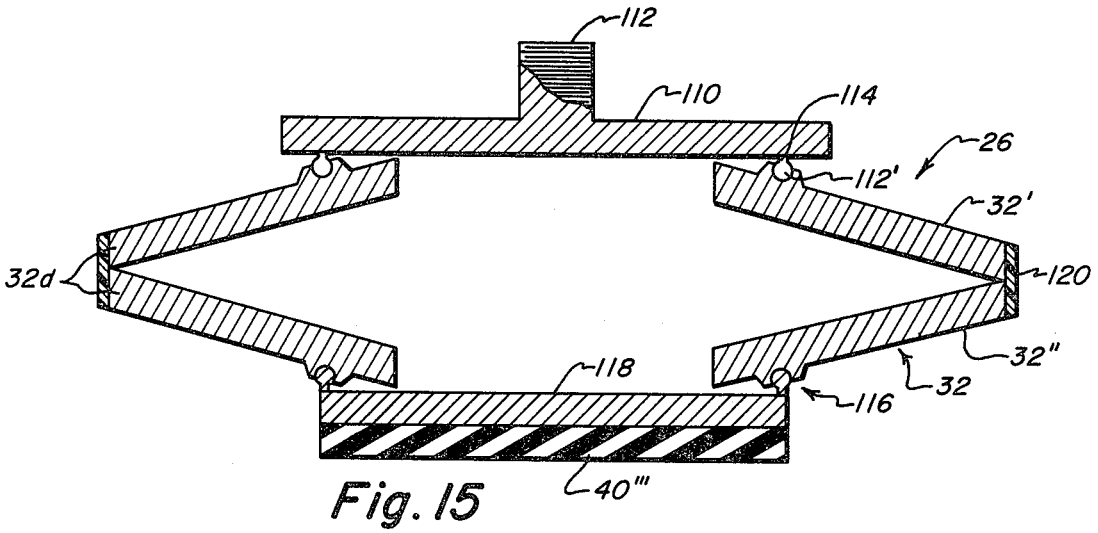
Fig. 15
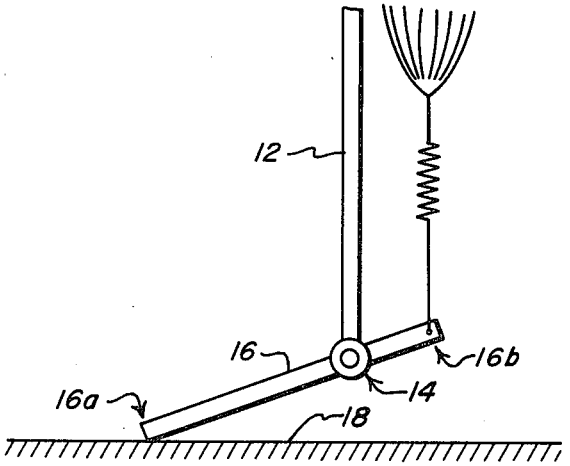
Fig. 16
Fig. 17
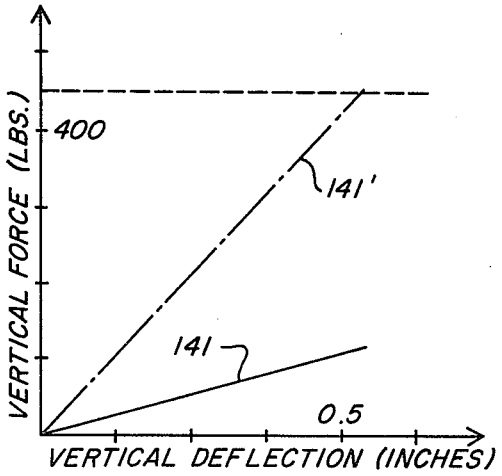

BIOMECHANICALLY TUNED SHOE CONSTRUCTION

BACKGROUND OF THE INVENTION

This invention relates generally to shoes. More specifically, it relates to a heel construction for a shoe characterized by a high degree of vertical compliance with substantially no lateral shear.

Recent work by applicants on the biomechanics of locomotion has led to the discovery that there is an optimal degree of "springiness" or vertical compliance which should be present at the interface between a person's foot and the surface on which he is walking or running. This discovery, which is discussed in more detail in applicants article, "Fast Running Tracks", appearing at pages 148–163 of the December, 1978 issue of *Scientific American,* contradicted the then conventional wisdom that a harder surface will produce a faster running time. Applicants construction for an indoor running track, now in use at Harvard University and pictured at page 163 of the *Scientific American* article, achieves this "tuned" response. In competitive running events, a principal advantage of a tuned surface is an increase in running speed. However, other important advantages are a reduction in the number of injuries associated with running and a general increase in the comfort of the runner. While ideally all surfaces, particularly all athletic playing surfaces, should provide this optimal degree of vertical compliance and the attendant advantages, this is, of course, not feasible. This is particularly true for amateur jogging where most running occurs on relatively hard surfaces such as concrete or asphalt sidewalks or roads.

In the manufacture of shoes, many arrangements have been used or suggested to cushion the shock of the foot striking the ground. A common expedient is simply to place a layer of resilient material in the shoe between the outer sole and the inner sole or the sock lining. There has been, however, no recognition that there is an optimal degree of vertical compliance for a shoe. Nor has there been any such arrangement which can provide a large degree of "cushioning" without compromising the performance of the shoe in other areas.

A fundamental design conflict is that a straightforward increase in the depth of the cushioning material results in an increase in its horizontal compliance or lateral shear. Horizontal compliance is undesirable because (1) it causes the foot to shift laterally with respect to the shoe at impact resulting in poor rearfoot stability and control, and (2) the energy transiently stored in the lateral deformation of this material is not returned to the runner. Thick cushioning layers also increase heel penetration, an undesirable vertical movement of the heel of the foot downwardly into the shoe on impact. These problems are accentuated in running shoes. The impact forces are much greater during running than walking and most amateur runners land on their heels rather than on the balls of their feet. During impact, the foot is at an angle with respect to the ground. The impact force therefore has a lateral or horizontal component, that is, a component directed generally along the sole of the shoe.

Another important design consideration is that the shoe construction should absorb as little as possible of the energy generated by the foot striking the ground. Stated in other words, the construction should transiently store and return energy to the runner efficiently.

Prior art shoe constructions, in general, neither recognize this as a desirable goal, or achieve it. Conventional resilient cushioning materials absorb energy, typically dissipating it as heat. Thus, the runner loses a significant portion of his vertical kinetic energy every time his foot strikes the ground.

Some other practical design considerations include the weight of the heel, its height, its durability and its weight distribution. In competitive running, it has long been recognized that light weight shoes are preferable. Thus, there has been a steady reduction in the weight of running shoes over the years, due principally to the utilization of modern synthetic materials and advanced construction techniques. It is also recognized that there are practical constraints on the height of a shoe heel, particularly the heel of a competitive running shoe. Extremely tall heels, for example heels in excess of 1 and ¼ inch are uncomfortable. Also, if the heel is formed of a resilient material, a tall heel exhibits a large lateral shear. Thus any practical heel design for a running shoe must be light weight, vertically compact, and rugged.

Most modern running shoes offer a relatively low degree of vertical compliance. The outer sole and heel are typically formed of a resilient material such as a high durometer polyurethane or a hard rubber. These materials are comparatively hard and stiff. Other layers forming the sole of the shoe typically include a layer of a more resilient material, but the composite structure remains, in general, comparatively hard and stiff. At the heel, the vertical compliance of almost all modern running shoes expressed as a spring constant (the inverse of compliance), is well in excess of 20,000 lbf/ft. At the front part of the shoe, for example at the ball of the foot, it is typically in excess of 35,000 lbf/ft.

Another known technique for providing cushioning is to form the outer sole of the shoe with a textured or ripple configuration. Such constructions, however, do not solve the aforementioned problems because (1) they do not provide an optimal degree of vertical compliance, (2) they suffer from lateral shear, and (3) they absorb the incident kinetic energy developed by the runner rather than efficiently returning it to him.

Another concept which appears in the prior art is to place a spring in the sole and/or heel of a shoe to provide cushioning. These spring designs, however, are deficient. None recognize that there is an optimal degree of vertical compliance for a given user and use. They merely recognize that some shock abosrbing cushioning is desirable. As to construction particulars, most of this prior art uses one or more coil or leaf springs located in the sole and/or heel of the shoe. One problem with these arrangements is that if the spring is large enough to provide a relatively large vertical compliance, then it is too heavy for use on a running shoe. Moreover, regardless of size, the springs depicted do not have enough vertical travel to store the large amount of energy developed during running. Further, while coil springs generally exhibit better energy storage characteristics then leaf springs, coil springs exhibit a large degree of lateral shear under a horizontal load. While some of the prior art patents disclose mechanical arrangements apparently intended to control the lateral shear of the coil spring or springs, they are generally heavy and impractical. A common such arrangement is to form the heel itself or spring support columns from two elements that are telescopically mounted for a vertical sliding movement.

Still another approach has been to utilize enclosed air as a cushioning medium. As with the spring patents, none of this "air cushion" prior art discloses any recognition that there is an optimal value for the vertical compliance of the shoe, particularly in its heel area. The air cushion is simply a shock absorber. While air has a great weight advantage over springs, air cushion designs suffer from a large degree of lateral compliance. Moreover, increasing the amount of the enclosed air or increasing the flexibility of the structure enclosing the air to increase the level of the vertical compliance accentuates the lateral shear problem. (This problem occurs even where the air is not entrapped, as, for example, where holes or channels are formed in the heel material to enhance its springiness and lower its weight.) Another problem is that the air cushions are inefficient in transiently storing energy. Energy from the runner is dissipated as heat rather than being returned to the runner.

It is therefore a principal object of this invention to provide a shoe construction, and in particular a heel construction for a shoe, that is biomechanically tuned to provide optimal performance characteristics for a variety of users and uses.

Another principal object of the invention is to provide a shoe construction that reduces the likelihood of injuries, particularly during running, or the aggravation of existing medical problems.

Another object of the invention is to provide a shoe that exhibits an extremely high degree of vertical compliance while at the same time exhibiting excellent rearfoot stability, rearfoot control, and a low level of heel penetration.

Still another object of the invention is to provide a shoe construction with replaceable heels to accomodate for wear and/or variations in the use of the shoe or the type of surface.

Yet another object of the invention is to provide a jogging shoe for use by amateur runners on sidewalks or hard surfaces as well as a training shoe for competitive runners that allows them to train harder with a reduced likelihood of injury.

Another object of the invention is to provide a competitive running shoe which can increase running speed on any surface.

Still a further object of this invention is to provide a shoe construction which is highly efficient in transiently storing and returning energy to the runner.

Another advantage of the invention is to provide a shoe construction with a comfortable heel height and which generally enhances the comfort of the person wearing the shoe.

Still another object of the invention is to provide a shoe construction having the foregoing advantages which can be manufactured from commonly available materials and uses conventional shoe uppers and soles.

Another object of the invention is to provide a heel construction for a shoe with the foregoing advantages that is comparatively light, durable, and has a competitive cost of manufacture.

SUMMARY OF THE INVENTION

The shoe construction of the present invention includes a heel that provides a force-deflection response that is biomechanically tuned to the person wearing the shoe, the use of the shoe, and the surface. The heel incorporates a main spring which has a comparitively large vertical compliance while exhibiting an extremely high resistance to lateral shear (horizontal compliance). The vertical compliance of the heel, expressed as its inverse, a spring constant, preferably lies in the range of 3,000 to 25,000 lbf/ft. For adult running, the heel construction preferably exhibits a maximum vertical deflection of $\frac{1}{8}$ to $\frac{5}{8}$ inch during the peak applied load, typically a spike of 400–500 pounds of force.

In a preferred form the main spring member is one which stores energy through a combination of localized stretching end compression rather than bending. In particular, the heel construction of the present invention preferably employs a coned disk spring or a vertical stack of operatively coupled coned disk springs. The coned disk main spring is preferably formed of a plastic having a Young's modulus in the range of 100,000 to 1,000,000 psi, good cyclic loading characteristics and high fatigue resistance.

The coned disk spring itself constitutes the heel or it is sufficiently large to occupy a significant fraction of the volume of the heel, usually extending vertically at least half the height of the heel and horizontally at least half the width of the heel. The coned disk spring is oriented with the axis of revolution of its coned surface aligned generally vertically with respect to the shoe. In one form, a pair of facing coned disk spring members joined at their larger diameter peripheries define, alone or in combination with other elements, an enclosed air chamber. The heel construction can include conventional valve means to adjust the air pressure within the chamber and thereby adjust the force-deflection response characteristics of the heel construction.

This main spring is preferably used in combination with a resilient member located in the heel area of the shoe and designed to complement the load deflection characteristics of the main spring. More specifically, the resilient member is designed to extend the force-deflection curve of the main spring member thereby providing an appropriate deflection or vertical compression of the heel as the applied force approaches its peak level. In general, the heel construction of this invention, whether utilizing a main spring alone or a main spring acting in cooperation with a resilient member, is characterized by "compression ratios" at a peak applied force during running of up to 2:1.

In a preferred form, a coned disk main spring is embedded in a foam rubber or plastic material which is molded in the form of a conventional heel. The foam material, which is typically either an open or closed cell foam rubber, is selected to provide the desired extension of the force-deflection response of the main spring. In general, the force-deflection curve should maximize the area under the curve (representative of the energy stored by the heel construction as a load is applied). In another form, the resilient member is a column of a highly resilient material such as a soft rubber or a low durometer polyurethane. The column is preferably located at the center of the coned disk spring. Still other forms of the invention employ resilient material between the outer sole of the shoe and the upper cone-shaped surfaces of the main spring, or conventional foam rubber or plastic materials which surround and embed the main spring in addition to the soft rubber column. In applications where weight considerations are less important, the resilient member can be a metallic coil spring. As a general rule, the main springs of the heel construction of this invention and the resilient material are preferably constructed so that approximately half of the vertical load on the heel is carried by a flexure of the main spring and half of the load is carried by a compression of the resilient material.

The heel construction of the present invention also includes various arrangements for mounting the heel construction to the sole of the shoe. If the main spring is embedded in a foam rubber material, the heel may be formed integrally with the outer sole or formed separately and secured to the outer sole using conventional techniques. In a replaceable form, the heel construction of this invention is secured to the outer sole through a mounting plate or assembly that can be secured to the sole. The mounting plate or assembly preferably secures the main spring with an annular ball and socket, snap-on joint or a series of tabs that engage small slots formed in the spring. The slots or snap-on joint preferably lie along the neutral axis of the main spring. In another form, the main spring can include an upwardly directed, cylindrical flange with threads formed on its outer surface that engage mating threads formed in the sole of the shoe. When the heel construction is secured to the sole of the shoe by a screw arrangement, the heel can include mechanical means such as a tab and set screw for securing the heel against rotation once it is firmly secured to the shoe, or the sense of the screw can be selected to utilize a natural twisting motion of the foot when it is in contact with the ground to automatically tighten the heel onto the shoe. In another embodiment, utilizing a coned disk member oriented with its large diameter uppermost, the mounting assembly can include a metallic spring clip which holds the cone disk spring member at its upper edge with a slight lateral clearance to allow for movement of the main spring during its flexure.

These and other features and objects of the invention will be more fully understood from the following detailed description of the preferred embodiments which should be read together with the accompanying drawings.

BRIEF DESCRIPTION OF THE DRAWINGS

FIG. 15 is a view in vertical section of still another embodiment of the invention utilizing a double coned disk main spring with annular ball and socket joints that secure the spring to a lower heel plate and an upper, threaded attachment plate;

FIG. 16 is a schematic diagram showing a highly simplified mechanical equivalent of the lower human leg and foot;

FIG. 17 is a graph showing several force deflection curves for several ordinary linear springs;

DETAILED DESCRIPTION OF THE PREFERRED EMBODIMENTS

Figure 1:
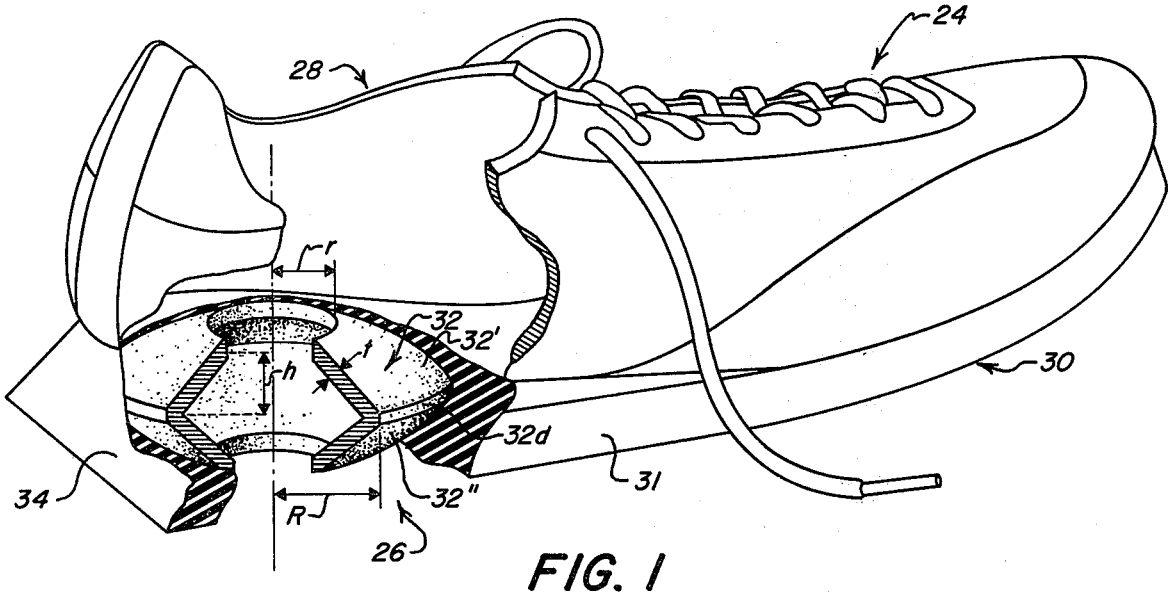
FIG. 1 is a perspective view with portions broken away of a running shoe constructed according to the invention and utilizing a double coned disk main spring embedded in a foam rubber material forming the heel.

FIG. 16 shows a simple mechanical equivalent of the lower portion of the human leg and foot. The tibia and fibula bones of the leg can be represented by a rigid, substantially vertical rod 12 which is typically connected at the ankle joint 14 to a foot 16 with the ankle joint being located between the midpoint and rear of the foot. The calf muscle and Achille's tendon of the leg act together substantially as shown. They are coupled to the rear portion of the foot on the opposite side of the ankle joint from the toe. The Achilles tendon can be viewed biomechanically as a spring coupled in series with the calf muscle. This system provides a large degree of compliance or "spring" for the foot and leg during walking or running, provided that the ball of the foot, located at approximately 16*a*, strikes the surface 18 before the heel of the foot located at approximately 16*b*. As is readily apparent from this model, when a person is standing, or when a person walks or runs with his heel striking the surface 18 first, then the substantial spring effect of the Achille's tendon does not come into play. This problem is particularly acute during running since some competitive runners and almost all joggers impact on the heel of the foot. As a result, the biomechanical structure of the body provides minimal cushioning of the extremely high and sudden applied forces generated by the collision of the heel with the ground. During running, these forces are typically 2.3 to 3.0 times body weight. Assuming that the runner has a weight of 180 pounds, the foot and leg of the runner experience a sharp spike of applied force when the heel strikes the ground of approximately 414 pounds of force (lbf). Typical peak forces during running for male adults range from 400 to 500 lbf.

As discussed in applicants' aforementioned *Scientific American* article, they have discovered that there is an optimal degree of "springiness" or vertical compliance. Its value was found to be far larger than had theretofore been considered desirable for an athletic playing surface. These findings contradicted the conventional wisdom prior to this work that the fastest running speeds would be associated with the hardest running surface. It has also been found that a surface which is highly compliant in the vertical direction will not only actually speed a runner, but will also reduce injuries commonly associated with running and enhance the comfort of running.

The optimal value for the vertical compliance of the surface will vary depending on factors such as the weight of the runner, the type of running (competitive, training, jogging), shoe size, the nature of the surface, and running style. For example, it has been found that for a male runner of average size engaged in competitive sprint running, the surface should have a vertical compliance, expressed as its inverse, a spring constant, of approximately 20,000 lbf/ft. However, for low speed running, for example, jogging at approximately 70% of competitive sprinting speeds, the optimal, "tuned" compliance of the surface is significantly lower. For the example given above, it would be approximately 10,000 lbf/ft. In general, the optimal compliance is inversely proportional to the square of the running speed. For the average amateur, adult runner engaged in jogging for exercise, or for a competitive athlete engaged in training, an optimal degree of compliance will lie in the range of 3,000 to 15,000 lbf/ft.

The present invention provides a shoe construction that yields a biomechanically optimal or "tuned" degree of vertical compliance. As noted above, no shoe known to applicants has been able to provide the comparatively high degree of vertical compliance required for jogging or training uses. Moreover, competitive running shoes known to applicants which have what have heretofore been considered relatively large degrees of compliance suffer from lateral shear and/or durability problems.

FIG. 1 shows a running shoe 24 constructed according to the invention which includes a heel construction 26 that provides a comparatively high degree of vertical compliance while at the same time exhibiting an extreme resistance to lateral shear. The shoe 24 has an upper 28 and sole 30, including an outer sole 31, of conventional construction. A main spring 32 is embedded in a foamed rubber material 34 having the external configuration of an ordinary running shoe heel. The heel material 34 preferably surrounds and fills the main spring 32. The heel 34 can be molded integrally with the outer sole 31 of the shoe and formed of the same material or it can be of a different material and secured to the outer sole by any conventional means such as glueing. If the heel is formed as a separate unit from the outer sole, it is possible to change the biomechanical characteristics of the shoe by removing the heel section 26 and adhereing a replacement heel section having somewhat different performance characteristics.

A principal feature of this invention is the main spring 32. In the embodiment shown in FIG. 1, the main spring is a double coned disk spring, that is, a pair of coned disk spring members which are operatively coupled at their outer edges. Each coned disk spring is a generally annular member having the configuration of a truncated conical shell. The coned disk spring generally has a constant thickness, t. Other important dimensions are the inner diameter, r, the outer diameter, R, and the height, h, of the cone, that is, the distance between a plane coincident with the upper edge of the inner diameter and a parallel plane coincident with the lower edge of the outer diameter. Loads are applied to the spring in the direction of its height (parallel to its axis of symmetry or the axis revolution of the cone surface). Coned disk springs differ from conventional springs in that they store mechanical energy under an applied load through a combination of localized stretching and compression, as opposed to bending. In all applications known to applicants, coned disk springs are formed of metals, particularly steel, but non-ferrous materials such as brass and bronze have also been employed.

Figure 18:
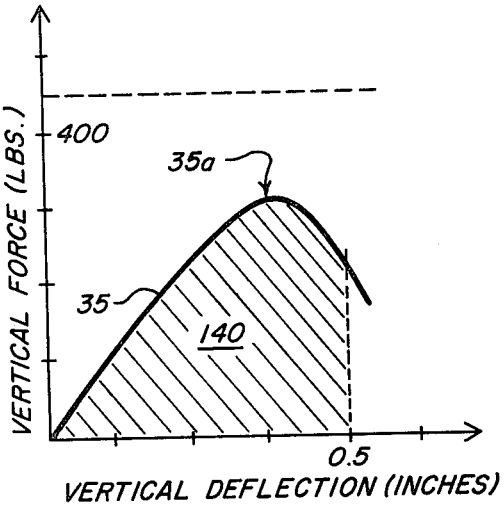
FIG. 18 is a graph showing force deflection curve corresponding to FIG. 17 for a typical coned disk spring for force levels experienced in running.

One extremely important feature of the coned disk main spring 32 is its capacity to store large amounts of mechanical energy efficiently. Also, relatively large amounts of energy can be stored with a comparitively smaller linear vertical displacement of the spring along its height. These characteristics are illustrated graphically in FIG. 18 showing a force-deflection curve 35 for a typical coned disk spring such as the spring 32 employed in the shoe 24 of FIG. 1. The deflection or vertical displacement of the spring along its axis of revolution is plotted on the abscissa; the load or applied force is plotted on the ordinate. As shown, the deflection is measured in inches and the applied force measured in pounds of force (lbf). A horizontal line 34 represents a typical peak applied force to the heel 26 of the shoe 24 during running by a male runner of average weight. A vertical line 36 represents the maximum vertical deflection of the spring for an optimal, tuned response.

It is significant that the curve 35 rises steadily from the origin in a roughly linear manner until a force level is reached where a spring member buckles (the region denoted generally at 35*a*). Once the spring buckles, increased applied loads are not accepted by the spring. The mechanical energy stored by the spring is represented by the area 140 under its associated force deflection curve. As long as a coned disk spring is operated short of its buckling point, it total energy storage capability, energy storage per unit deflection, and energy storage per unit mass of the spring are all exceptionally good.

Figure 19:
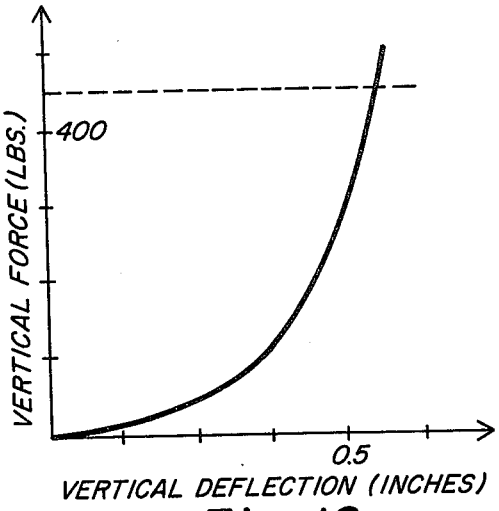
FIG. 19 is a graph showing a force deflection curve corresponding to FIGS. 17 and 18 for a column of soft rubber.

The performance of the coned disk spring 32 is in sharp contrast to the load deflection response of ordinary leaf spring members (FIG. 17) or resilient members such as a narrow column of soft rubber (FIG. 19). FIG. 17 demonstrates that the force-deflection curve 141 of an ordinary spring, which stores energy by a bending mode, is linear and comparitively flat compared to the corresponding curves of a coned disk spring. (While springs with a higher rate can store more energy during the same compression, as represented by curve 141 in FIG. 17, as noted above, such springs are comparatively heavy for use in a running shoe.) Also, the area under the forced deflection curve 141 is relatively small as compared to a cone disk spring member, at least when the comparison is being made for applied forces short of the buckling point of the coned disk spring. The force-deflection curve shown in FIG. 19 is characterized by an extremely flat initial response (a small increase in the applied force results in a large deflection), but a steadily increasing resistance to deflection as the force levels are increased. The curve shown in FIG. 19 can also be characteristic of certain coil springs when used within certain operational limits.

Figure 20:
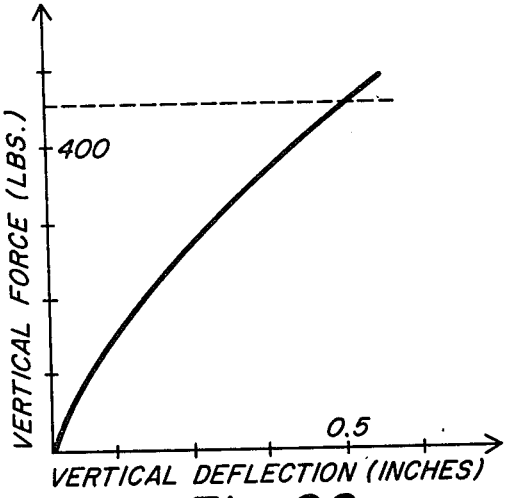
FIGS. 20–22 are each graphs showing forced deflection curves with a response characteristic of a heel construction according to the invention and utilizing both a coned disk main spring and a resilient member designed to extend the force-deflection curve of the coned disk spring.
Figure 21:
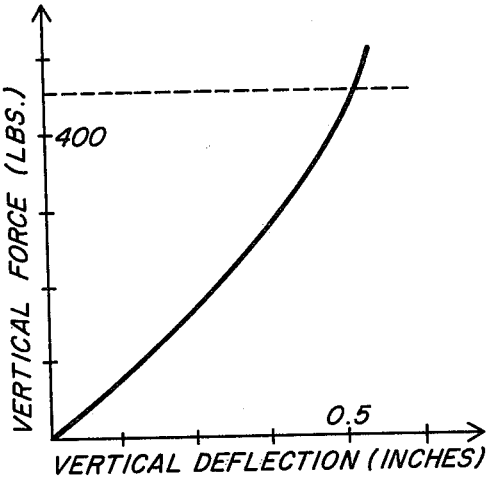
Figure 22:
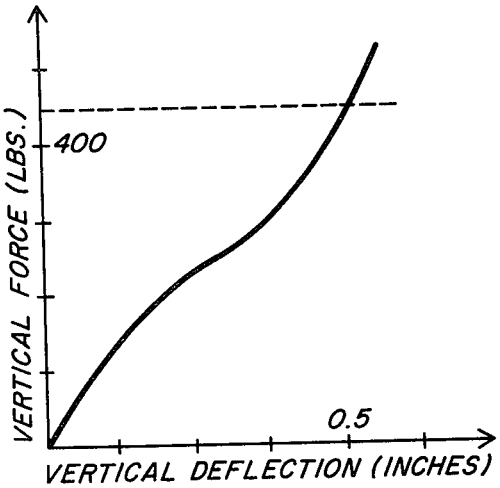
Figure 23:
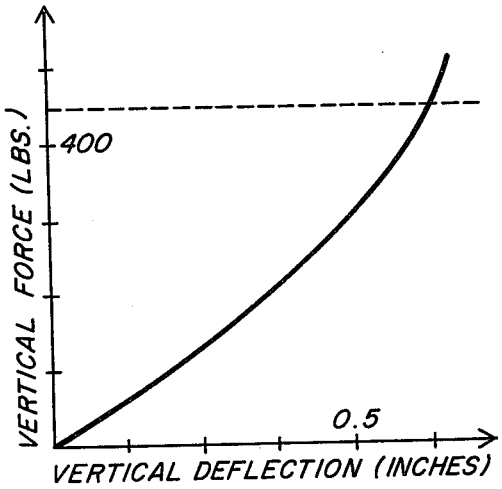
FIG. 23 is a graph corresponding to FIGS. 20–22 showing a force deflection curve for a training shoe according to this invention.

In a preferred form of this invention, a main spring of one or more coned disk springs is operatively coupled with a resilient member having a force deflection curve similar to the one shown in FIG. 19. This combination efficiently stores mechanical energy over a range of applied loads up to a spike peak applied load for a given runner and running conditions. FIGS. 20–22 show various possible force deflection curves for combinations of coned disk springs and resilient members. The shape of a particular curve will depend principally on the characteristics of the particular coned disk main spring as well as those of the particular resilient member employed. FIG. 20 depicts the force deflection curve of a heel construction 26 that is suitable for multi-purpose use, including walking and jogging. FIG. 21 shows a curve suited for a training shoe. FIG. 23 shows another curve suitable for a training shoe. Note that the curve of FIG. 23 indicates an enhanced maximum vertical deflection as compared to FIGS. 20–22. FIG. 22 shows a curve which offers a reasonable approximation to a linear response.

Regardless of a shape of a particular curve, it is important that the load-deflection response of the resilient member "extends" the force deflection curve of the coned disk main spring beyond its buckling point and at least up to the anticipated peak applied loads during use. An advantage of this invention is that the shape of the force-deflection curve of the heel construction 26 can be selected to yield the optimal results for a given user, use and surface. For example, where the shoe is being used on a compliant surface such as a layer of conventional plastic material or a surface constructed according to applicants' playing surface invention such as the present indoor running track at Harvard University, the response of the heel can be significantly less compliant than otherwise, particularly at initial impact. The force-deflection curve can also be adjusted to optimize the comfort of conventional walking shoes or to provide optimal cushioning for orthopedic shoes.

In the FIG. 1 embodiment, the material 34 functions as the resilient member that extends the force-deflection curve of the main spring 32. The resilience of the material 34 is therefore important consideration in the proper design of a shoe according to the present invention. In general, an increase in the resilience of the material 34 results in a corresponding increase in the energy return efficiency of the heel construction 26 of the present invention. If the material 34 has comparatively poor resilience qualities, it will absorb a significant fraction of the incident mechanical energy of the runner. (This energy is typically lost as heat generated by the compression of air within the resilient material which is then conducted away to the surrounding air.)

In the FIG. 1 embodiment and the other embodiments described below, however, the coned disk main spring 32 (or an equivalent element) is the principal member for storing and returning energy to the runner. The efficiency of the resilient material is therefore of lesser importance than the efficiency of the main spring for most applications. Also, while the material 34 both surrounds and fills the main spring 32, it is possible to have the material 34 only surround or only fill the main spring.

The operating characteristics of a coned disk spring are determined by its constituent material, its dimensions, and its configuration. An important characteristic of the material is its modulus of elasticity (Young's modulus). For use in the present invention, the coned disk spring should preferably have a Young's modulus in the range of 100,000 to 1,000,000 psi with a typical value being 200,000 psi. The material must also exhibit good cyclic loading characteristics and high fatigue resistance. Durability over $10^6$ loading cycles is preferred. Material cost, weight and the ability to cast and machine the material are also considerations. Another significant feature of this invention is the use of plastic materials to form the coned disk main spring. Several different grades of nylon meet all of the foregoing requirements and nylon is a preferred material. A particular advantage of nylon coned disk springs is that they are capable of efficiently storing and returning to the runner up to 95 to 98 percent of the incident energy. Conventional synthetic foamed plastics are significantly less efficient. Other suitable materials for the coned disk main spring 32 include the material sold under the trade designation "Delrin", polyvinyl chloride plastics, fiberglass, fiber reinforced resins, and cellulose acetate butyrate.

Figure 3:
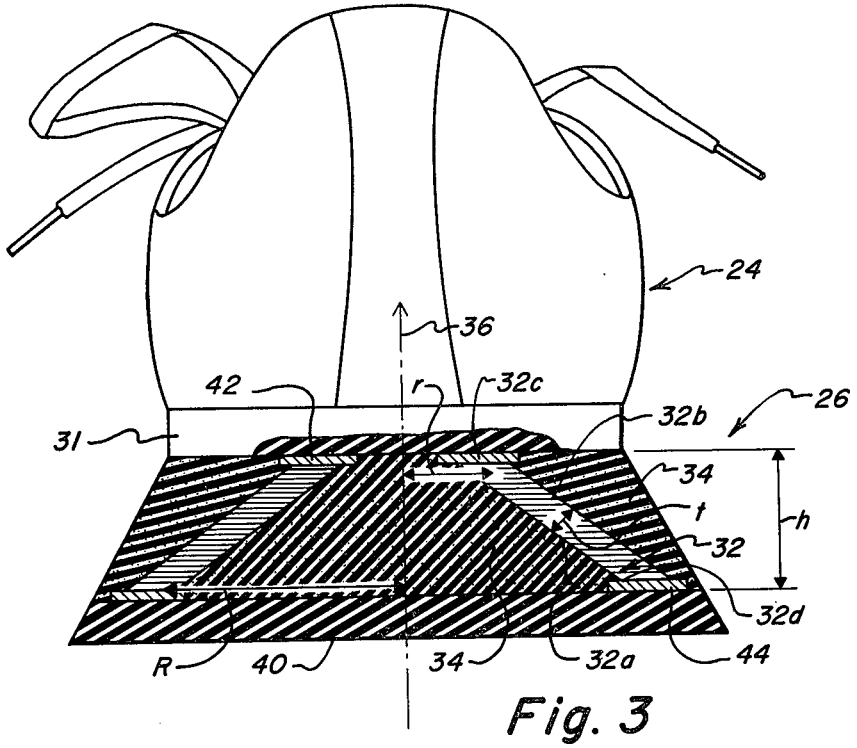
FIG. 3 is a view in rear elevation and partially in section of a running shoe constructed according to the invention of the general type shown in FIGS. 1 and 2 utilizing a single coned disk spring.

The general configuration of a coned disk main spring according to this invention is that of a truncated conical shell. It is usually open at its upper and lower ends. The inner surface **32*a* and outer surface 32*b* of the cone (FIG. 3) are typically parallel and symetric about an axis of revolution of the cone surface indicated in FIG. 3 by a vertically oriented arrow 36. FIG. 3 also illustrates the dimensional parameters of the coned disk spring (t, h, r, R). For most common materials, the force deflection characteristics of a particular cone disk spring are to a large extent determined by the ratio h/t. (It should be noted that the force-deflection curve shown in FIG. 18** is representative of coned disk springs having an h/t ratio in the range of 1 to 3. Such springs with markedly different h/t ratios exhibit different force-deflection responses. Depending on the specific application, such other main springs may or may not be satisfactory.) In general, the spring stiffness is increased by increasing its thickness, t.

FIGS. 1–15 illustrate a variety of coned disk main springs constructed according to the present invention. In each case, the materials, configuration, and dimensions of the coned disk spring member are designed to yield the desired vertical deflection characteristics while at the same time meeting the constraints imposed on the spring as the heel or a component of the heel of a shoe. Thus, for example, the initial, no-load height h of the spring should be sufficiently small to provide a relatively flat and comfortable heel. Typical values for h range from $\frac{3}{8}$ inch to 1 and $\frac{1}{8}$ inches. The width of the heel places a limit on the outer radius R of the main spring. When the main spring itself forms the heel, it should not extend laterally for a significant distance beyond the sides of the shoe upper. Where the coned disk spring member is embedded in the heel of the shoe, the outer radius R will typically be less than the maximum width of the heel, as shown. In general, however, the outer radius R should be as large as possible to provide good rearfoot stability for the shoe and enchance the ability of the coned disk main spring, and hence the heel construction 26, to resist lateral or horizontal shear forces. An important feature of the present invention is that the coned disk main spring 32 used in the heel construction exhibits an extreme resistance to lateral shear. As a rough measure of this resistance, a heel construction according to this invention will typically deflect less than 0.050 inch in a lateral direction with an applied lateral force of 400 lbf.

The following discussion of the FIGS. 1–15 embodiments will illustrate another significant advantage of coned disk springs, that is, they can be stacked vertically with their adjacent inner or outer rims operatively coupled to one another to provide a composite spring which exhibits a larger vertical compliance than a single spring or a shorter stack. This type of stacking is termed "series" as opposed to "parallel" where two or more cones are nested with their conical surfaces abutting one another. Vertical series stacking offers a relatively large vertical deflection of the main spring, and hence of the heel construction as a whole, for a given applied load. As a general rule, the larger the number of cone disk springs in the series stack, the larger the vertical deflection of that stack under the same applied load. FIG. 14 illustrates another stacking arrangement where a pair of coned disk spring members are held in a parallel but spaced apart relationship by a stiffly resilient mounting bracket 38. It is also possible to use a vertical stack in the heel construction of this invention that mixes series and parallel stacking.

Some other considerations common to all of the coned disk spring embodiments described herein are mounting of the spring to the shoe and wear induced by the spring on other members due to its movement during flexure. FIGS. 1–6 embodiments utilizing embedded coned disk springs rely upon the inherent resiliency of the material surrounding the coned disk spring to accommodate for the flexing movement. Where necessary, regions of potentially high wear can be protected by small rings or sheets of a structural material having a good resistance to wear and preferably exhibiting a relatively low degree of sliding friction. A suitable material is stainless steel or the plastic sold under the trade designation Teflon.

Turning again to FIG. 1, the coned disk main spring 32 is a double coned disk spring in a series vertical stack with the outer edges **32*d* of upper and lower coned disk springs 32' and 32'', respectively, operatively coupled to one another. As shown, the spring 32 is cast as a single integral member with no seam at the outer edges 32*d* of the springs 32' and 32''. In this form the large diameter edges of the springs 32' and 32'' can meet in a region that is somewhat thinner than the thickness t of the springs themselves to facilitate movement of this region during flexure. It is also possible to form the main spring from separate springs which are fused, bonded, or mechanically coupled to one another at their adjacent edges. In the FIG. 1 embodiment, it is also possible to secure the springs 32' and 32'' in a stacked alignment using the surrounding foam material 34**.

The combined force-deflection curve of the main spring 32 and the resilient material 34 in the heel area of the shoe is selected to provide the optimal tuned response for the runner, the type of running, and the nature of the surface. The FIG. 1 embodiment is suitable for both a competitive running shoe and a training or jogging shoe where the vertical compliance of the heel construction must be significantly larger. As noted above, for competitive running the compliance is preferably about 20,000 lbf/ft and for jogging it is preferably in the range of 3,000 to 15,000 lbf/ft. In either case, the resilient material functions in cooperation with the main spring to extend its force-deflection curve as described above with regard to FIGS. 20–23. Also, the resilient material 34, in addition to having the required resilience qualities, must also accommodate movement of the main spring during a loading cycle in a manner which does not interfere with the functioning of the spring or cause excessive wear to the resilient material itself. While the resilient material 34 may be the same material forming the outer sole, it is also possible to use a material exhibiting different characteristics, for example a softer or more resilient material. In this case, it may be advisable to include a layer or heel pad 40 of a highly wear resistant material at the bottom surface of the heel construction, as shown in FIGS. 3–6.

It should be noted that the compliance values expressed herein are to some extent dependent on the area of the shoe over which the force is applied. To standardize measurements, applicants have used a 1 and $\frac{3}{4}$ inch flat aluminum disk to simulate the heel of the foot. The applied force has been a static load. In general, common resilient materials and conventional running shoes employing those materials exhibit a sensitivity to the area over which the running force, or simulated running force, is applied. A significant advantage of the present invention is that the response characteristics of the heel construction 26 are substantially area independent.

Figure 2:
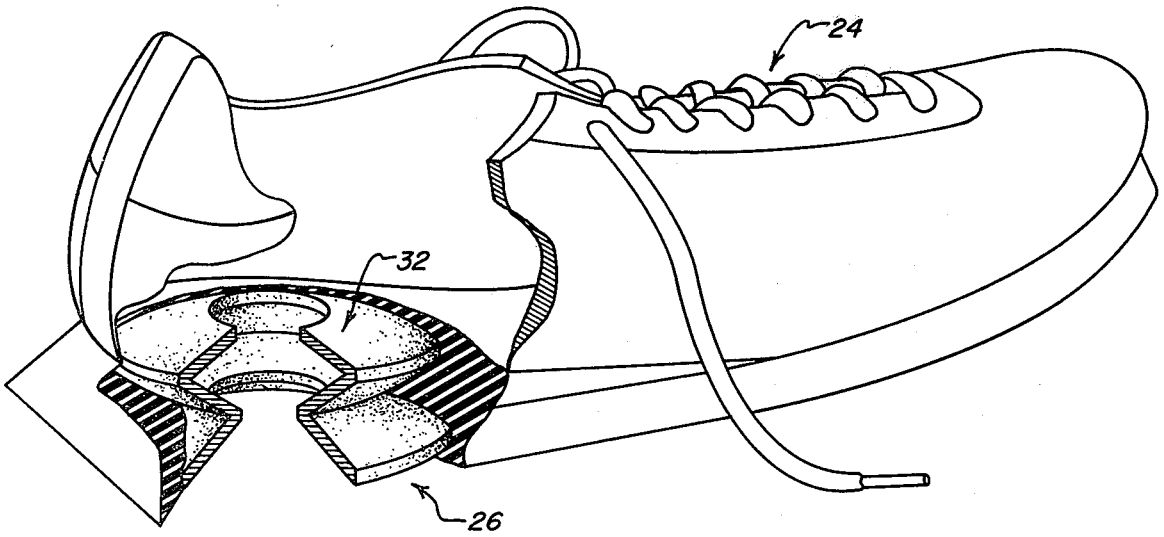
FIG. 2 is a perspective view corresponding to FIG. 1 showing an alternative embodiment of the invention utilizing as its main spring three series stacked coned disk springs.

FIG. 2 illustrates an aternative emobdiment of the invention which is similar to the embodiment shown in FIG. 1 except that the coned disk main spring 32 (like parts being in the various Figures being accorded like reference numerals) is a vertical series stack of three coned spring members rather than two. This embodiment, in general, will result in a heel having a greater overall height, but it will also provide a heel which is capable of a comparatively large deflection (actually, a vertical compression of the heel construction). The shoe shown in FIG. 2 is particularly useful as a training or jogging shoe. The heel constructions 26 shown in FIGS. 1 and 2 typically have a height of approximately one inch and utilize main springs 32 that occupy at least half of the volume of the heel.

FIG. 3 illustrates an alternative embodiment of the invention which is similar to the embodiments shown in FIGS. 1 and 2 except that the main spring 32 is a single coned disk spring. Also, while the spring 32 is embedded in the resilient material 34, the lower edge of the cone disk member is supported on the heel pad 40 which is adhered to the resilient material 34. The FIG. 3 embodiment, like the other illustrated embodiments, shows the main spring 32 in an undeflected or "no-load" position. When a load is applied, that is, when a runner wearing the shoe stands or lands on the heel construction 26, the spring 32 and a resilient material 34 will compress in a vertical direction to provide the desired load deflection response. The maximum compression of the composite heel construction 26 will typically be in the range of 2:1 for running and during the peak applied loads, that is, the volume of the heel under a peak load is approximately half of its volume when no load is applied. It should be noted that because of the unusually large degree of compressibility of the heel construction 26 of this invention, the unloaded, initial heel height can be larger than would be acceptable for conventional shoes. When a person wearing the shoe 24 stands, the heel height will decrease as the heel compresses.

The upper and lower edges 32*c* and 32*d* of the spring 32 will move laterally during the flexure of the spring 32. The edges 32*c* and 32*d* will therefore be in sliding contact with the outer sole 31 and the pad 40. To control the resultant wear, annular rings 42 and 44 formed of a wear resistant material can be secured to the members 31 and 40 and located so that the edges 32*c* and 32*d* of the spring abut and slide along these rings.

The shoe shown in FIG. 3, since it employs only a single coned disk spring, will typically provide less vertical compliance than many of the other embodiments described herein. This shoe, however, is suited for use as a competitive running shoe since this use requires less vertical compliance for an optimally tuned response. In addition, the relatively low height of the heel reduces the weight of the heel construction of the shoe and is comparable to the heel height of the present commercial running shoes for competitive purposes. A typical heel height is ½ inch.

Figure 4:
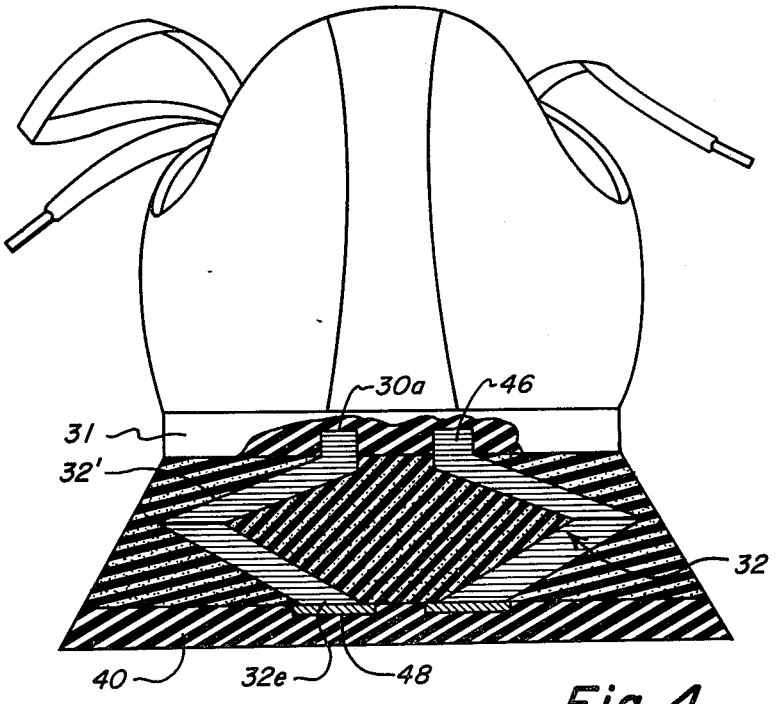
FIG. 4 is a view in rear elevation and partially in section corresponding to FIG. 3 and showing an alternative embodiment of the invention utilizing a double coned disk main spring which includes a flange portion at the inner edge of the upper coned disk spring which engages the outer sole of the running shoe.

FIG. 4 shows a further embodiment of the invention utilizing a double coned disk main spring 32 as in FIG. 1, but also including heel pad 40 and a flange 46 formed integrally with the upper coned disk spring 32'. The flange 46 is engaged in a recess 30*a* formed in the sole 32. The flange 46 secures the spring to the sole and limits the lateral movement of the upper edge of the spring 32' to control wear at the outer sole. However, limiting the movement of the spring at this point also changes its performance characteristics. In particular, the spring 32 exhibits a greatly increased vertical stiffness as compared to a spring of the same general type (as shown in FIG. 1) not having the flange 46. The FIG. 4 shoe provides a larger vertical compliance than the FIG. 3 shoe and is suitable for use as either competitive running or a training or jogging shoe. A wear plate 48, like the rings 42 and 44, can be provided as a bearing surface for the lower face 32*e* of the spring 32 opposite the flange 46. For competitive running, this embodiment also has the advantage of reducing the size and weight of the wear plate 48 as compared to embodiments requiring two wear plates (upper and lower) or embodiments where the large diameter of the coned disk spring abuts the plate. The weight reduction in particularly important in running shoes and where the plate 48 is formed of a dense, metallic material.

Figure 5:
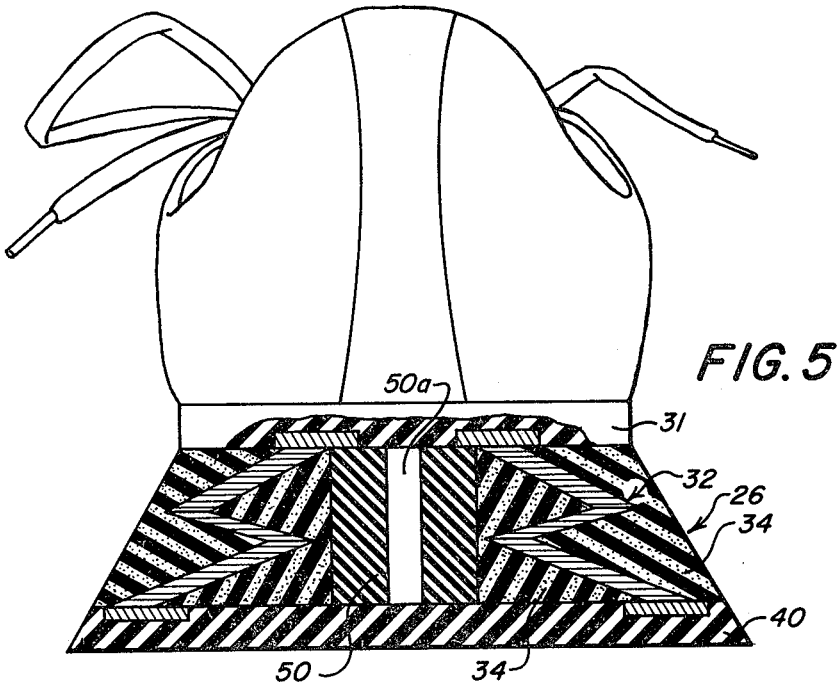
FIG. 5 is a view in rear elevation and partially in section corresponding to FIGS. 3 and 4 and showing an alternative embodiment of the invention utilizing three coned disk springs in a vertical series stack as shown in FIG. 2 but also incorporating a central column of soft rubber.

FIG. 5 illustrates another embodiment of the invention utilizing a three-element coned disk main spring 32 like the spring 32 of FIG. 2. In the FIG. 5 embodiment, the spring 32 is sandwiched vertically between the outer sole 31 and the heel pad 40 as in the FIGS. 3 and 4. Again, the spring 32 is embedded in a foam rubber material 34 or an equivalent. The major distinction of the FIG. 5 embodiment is the presence of a narrow, hollow column 50 of soft rubber or a material exhibiting comparable resilience characteristics. The material is preferably the rubber forming the product sold under the trade designation "Super Ball", but it can be any material having a suitably low durometer reading, typically in the range of 15 to 35.

The column 50 can be solid or have a central aperture 50*a* as shown. The outside diameter of the column is typically approximately 1 inch and the column extends vertically from the outer sole 31 to the pad 40. A principal advantage of the column 50 is that it offers a highly efficient return of energy to the runner as compared to foam rubber or the like. The coned disk spring 32 provides an "exoskeleton" or surrounding support structure for the soft rubber column which controls what would otherwise be a enormous lateral shear of a narrow column of soft rubber. The heel construction 26 of FIG. 5 thus derives a biomechanically tuned degree of vertical compliance from the spring 32 and the rubber column 50, with some contribution from the resilient material 34. The main spring 32 provides a high degree of resistance to lateral shear which neither the rubber column 50 nor the resilient material 34 could provide.

Figure 6:
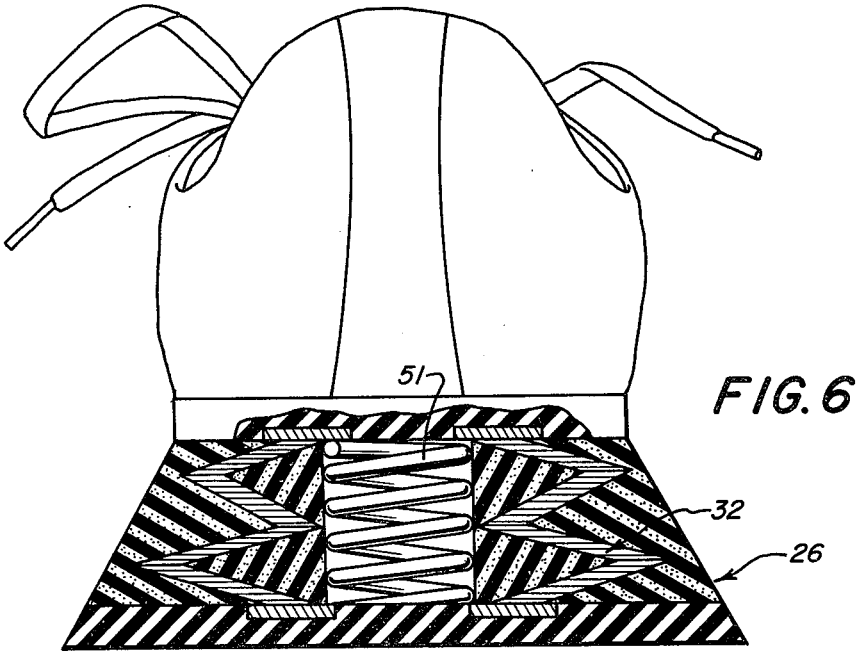
FIG. 6 is a view in rear elevation and partially in section corresponding to FIGS. 3–5 showing an alternative embodiment of the invention using four coned disk springs stacked in series which act in cooperation with a central coil spring.

FIG. 6 shows an embodiment of the invention which is similar to the embodiment shown in FIG. 5 except that the main spring 32 is a vertical, series stack of four coned disk springs and the function of the central column of soft rubber is performed by a coil spring 51. The heel construction 26 is slightly taller than that shown in FIG. 5. A typical heel height is 1 and ¼ inches. The FIG. 6 embodiment is particularly well suited for use in jogging or training shoe where a large degree of vertical compliance is desired.

In the embodiments shown in FIGS. 1–6, the spring element is fixed to the shoe by embedding it in a resilient material which in turn is secured to the outer sole of the shoe or is integral with the outer sole. In contrast, the embodiments shown in FIGS. 7–9, and 11–15 describe heel constructions according to the present invention which are replaceably secured to the outer sole of the shoe. The heel can thus be conveniently replaced when it becomes worn or when a heel construction having different operating characteristics is desired to match a change in the use of the shoe or the running surface.

Figure 7:
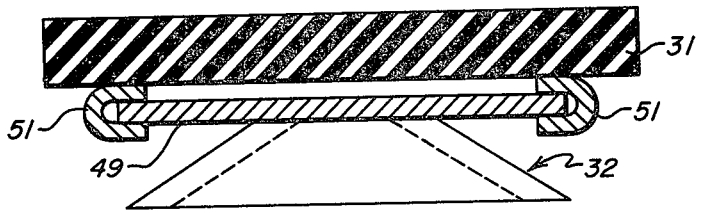
FIG. 7 is a detail view in section of a replaceable mounting system for a heel construction according to this invention.

FIG. 7 shows a mounting arrangement according to the present invention for replaceably securing a coned disk heel construction of the type described above to a portion of the outer sole of a shoe located over the heel. A mounting plate 49 is secured to the upper end of the main spring 32. An opposed pair of channels 51 secured to the outer sole receive and engage the plate 49. The heel construction is secured to or removed from the shoe by sliding the plate 49 along the channels 51. A conventional spring loaded latch (not shown) or any equivalent mechanical locking arrangement secures the plate in the channels when it is fully inserted. The channels 51 can be oriented parallel to the general direction of the shoe 24, as shown, or with any other orientation including one transverse to the shoe.

Figure 8:
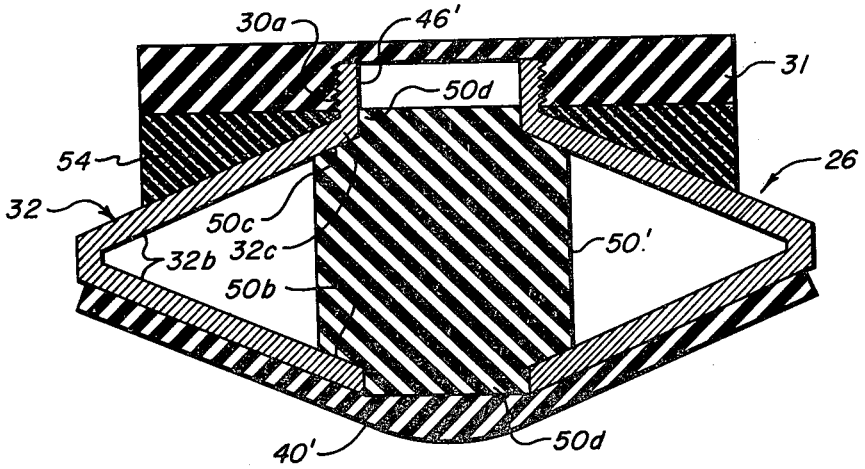
FIG. 8 is a view in vertical section of an alternative embodiment in the invention utilizing a double coned disk main spring, a central column of soft rubber, and a threaded flange formed on the upper coned disk spring for replaceable attachment to the sole.

The embodiment shown in FIG. 8 utilizes a double coned disk main spring 32 with an upstanding, generally cylindrical flange 46' secured at the upper edge 32*c* of the spring. The flange 46' has a thread form on its outer surface which engages a mating thread formed in an annular recess 30*a*′ in the sole 30 (or the outer sole 31) of the shoe. The entire heel construction 26, which is defined principally by the spring 32 itself, can therefore be simply screwed or unscrewed from the sole of the shoe to effect the replacement. Preferably, the sense of the threads formed the flange 46′, i.e., right hand or left hand, are different depending on whether the shoe is constructed to be worn on the left or right foot. More specifically, the sense of the thread is selected to utilize a slight, natural twisting motion of the foot during walking or running when it is in contact with the ground to automatically tighten the heel onto the shoe. A clockwise or righthand thread usually tightens on a right foot shoe. It should be noted, however, that this twisting motion may be negligible for some runners.

The FIG. 8 embodiment is also different from the FIGS. 1–6 embodiments in that the spring 32 is not embedded in a foam material that defines the heel of the shoe. Rather, the coned disk spring itself is the major structural component of the heel and defines its shape. The force-deflection characteristics of the main spring 32 are complemented by a column 50′ of soft rubber or equivalent material. The column 50′ functions in the same manner as the column 50 described above with respect to FIGS. 5 and 6 except that the column 50′ is solid and has a conical shoulders 50*b* and 50*c* which terminate in reduced diameter end portions 50*d*, 50*d*. The configuration of the shoulders 50*b* and 50*c* and the end portions 50*d*, 50*d* are selected to engage the inner edge 32*c* of the spring 32 at both its upper and lower end as well as a portion of its interior conical surface 32*b* adjacent the inner edge. This arrangement both operatively couples the rubber column with the spring 32 to provide the complemented response characteristics described above and physically secures the rubber column in a position centered on both the shoe and the spring member.

The column 50′ extends from the lower surface of the outer sole 31 at its upper end 50*d* to the upper surface of a highly wear resistant heel pad 40′ adhesively secured over the lower face of the spring member 32. The pad 40′ serves the same function as the pad 40 in the FIGS. 3–6 embodiments. The pad 40′ is preferably a hard rubber or high durometer polyurethane, e.g., one having durometer values in the range of 80–90. The heel construction 26 shown in FIG. 8 also includes an annular, triangular cross-section washer 54 preferably formed of a resilient foam rubber or plastic material. The washer 54 fills the space between the outer sole 31 and the upper cone disk spring element 32′ of the main spring. It also provides some vertical compliance during the maximum flexure of the spring 32, prevents an accumulation of dirt in the crevis between the outer sole 31 and the spring 32, and enhances the overall appearance of the heel. In this embodiment the main spring 32 preferably carries approximately half of the peak load applied to the heel construction 26 and the rubber column 50 carries approximately the other half of the load. The main spring 32, as in the other embodiments, provides a high degree of lateral stability to the heel.

It should be noted that the FIG. 8 embodiment also has the advantage of being extremely light weight and both air tight and water tight. The lightness of this design is attributable in part to the fact that the heel is formed of an "exoskeleton" structure and therefore much of the heel volume is occupied by air. Also, the main spring is not enclosed in a rubber or plastic material. For use in running shoes, this embodiment is capable of attaining a heel weight in the range of 40–80 grams which is competitive with heel weights of running shoes presently on the market. (The weight of a complete running shoe can range from 220 to 500 or more grams.) The fact that the heel construction is air tight and encloses a body of air is also advantageous because the air can provide some degree of cushioning. By way of illustration but not a limitation, a heel construction of the type shown in FIG. 8 can have a maximum outside diameter of three inches, a rubber column with an outside diameter of approximately one inch and an overall height of approximately one inch.

Figure 9:
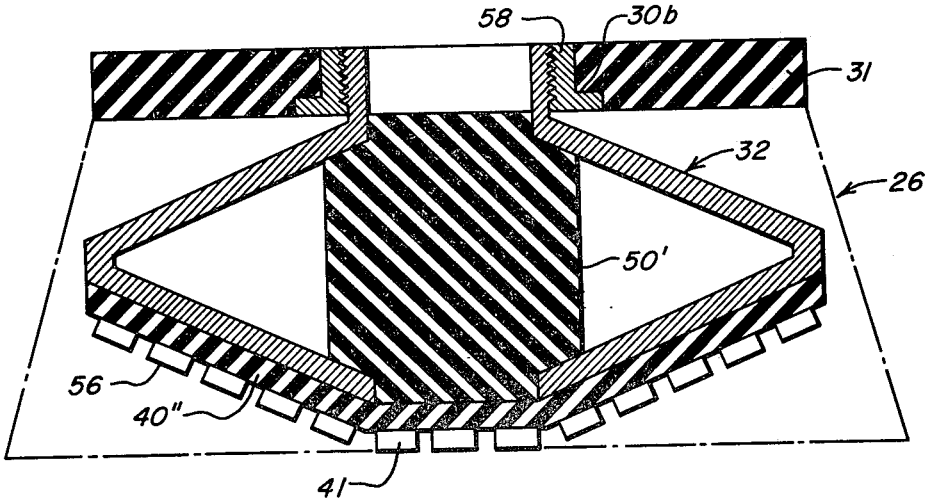
FIG. 9 is a view in vertical section of an alternative embodiment of the invention of the same general type as shown in FIG. 8.

FIG. 9 shows yet another embodiment of the invention which is similar in construction to the embodiment shown in FIG. 8. As in FIG. 8, the main spring is a double coned disk spring 32 which defined an enclosed, air-tight and watertight space. The spring is preferably formed as a single piece of nylon. Again, the bottom surface of the spring 32 bears on a heel pad 40″ of a wear resistant material such as hard rubber or a high durometer polyurethane. The pad 40″, however, has a pattern of treads 41 formed on its lower surface. A column 50′ of soft rubber is seated in the center of the spring 32 and operatively coupled with it.

A significant difference between the FIG. 9 and FIG. 8 embodiments is that in the FIG. 9 embodiment the threaded flange 46′ formed at the upper end of the spring 32 screws into a threaded metallic ring insert 58 which in turn is engaged in a recess 30*b* formed in the sole 30 of the shoe. This arrangement insures that the threads in the sole will be of a material which is strong and durable. Another disadvantage is that the threads can be formed on a separate metallic member which can then be secured to the sole rather than forming these threads directly into the sole (or outer sole) material.

Figure 10:
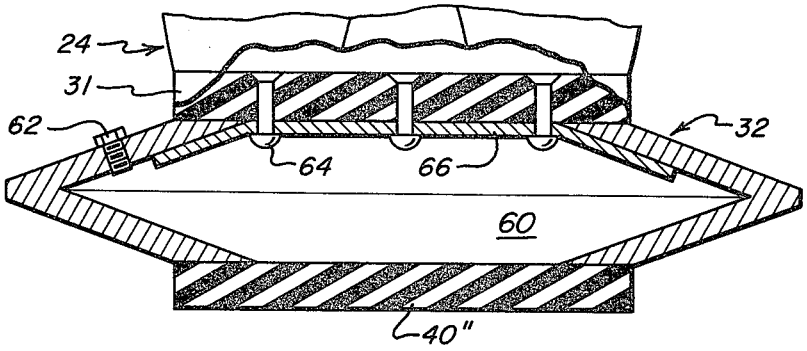
FIG. 10 is a view in vertical section of a heel construction according to the invention utilizing a double coned disk main spring.

FIG. 10 describes yet another embodiment of the invention utilizing a double coned disk main spring 32 which itself forms the heel of the shoe. In contrast to the embodiments discussed previously, the heel of the FIG. 10 embodiment does not incorporate any resilient material. Rather, the spring 32 forms an air-tight chamber 60 which holds a body of entrapped air. Since the air is compressible, it acts like a resilient member to "extend" the load deflection response of the main spring in the same manner as the resilient material 34 or the soft rubber columns 50 or 50′. The degree of the resilience or cushioning effect of the trapped air varies with the pressure of the air and its volume. In a preferred form, the heel construction shown in FIG. 10 includes a conventional valve assembly 62 secured in a side surface of one of the cone disk spring members near its neutral axis. The valve assembly 62 allows the user to vary the air pressure within the heel in the manner of an automobile tire. An increase in the air pressure results in a decrease in the vertical compliance of the heel.

The heel construction shown in the FIG. 10 embodiment is secured to the sole of a shoe by a set of rivets 64 which are fimrly engaged in the sole 30. The rivets 64 pass through an upper mounting plate 66 which spans the opening at the upper end of the spring 32 and is secured to it with an airtight seal. While the spring 32 is shown as being secured to the shoe upper by means of rivets 64, it will be understood that any of a wide variety of permanent fasteners or fastening arrangement can be used instead of the rivets, including adhesive bonding. The lower surface of the cone disk spring member 32 has a substantially co-extensive heel pad 40″ replaceably secured to the bottom surface of the cone disk spring member, whether by adhesives or other mechanical interlocking arrangements. The pad 40'' can therefore be replaced when it is worn.

Figure 11:
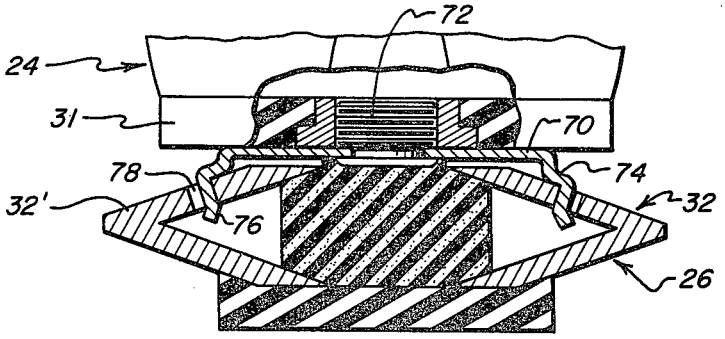
FIG. 11 is a view in vertical section of a heel construction according to the invention utilizing a double coned disk main spring of the type shown in FIG. 10 together with an attachment ring for replaceably interchanging heels on the shoe.

FIG. 11 shows a heel construction 26 which is similar to the embodiment shown in FIGS. 8–10 in that it employs a double coned disk main spring 32 which itself forms the heel of the shoe. The main spring optionally supports an internal rubber column in a manner shown in FIG. 8 or 9. A distinctive feature of this embodiment is that the heel construction 26 is replaceably secured to the outer sole of the shoe by an attachment ring 70 which includes an upstanding, threaded mounting stud 72 and a downwardly projecting flange 74. The lower edge of the flange 74 carries a set of angularly spaced tabs 76. The stud 72 threads into a mating threaded hole formed in either the sole 30 or in an intermediate element such as the metal ring insert 58 (FIG. 9). The sense of the threads is again preferably selected so that the natural twisting motion of the heel of the foot automatically tightens the attachment ring against the sole of the shoe.

The attachment ring 70 is secured to the coned disk spring by the tabs 76 which engage an aligned set of slots 78 formed in the upper cone disk spring 32'. The tabs 76 penetrate the slots 78 and hold the spring 32 against the attachment ring 70 due to a spring force of the tabs 76 bearing against the side walls of the slots 78 and/or a mechanical arrangement where the tips of the tabs are bent over. A suitable cushioning material can be provided between the attachment ring and the main spring to avoid noise generated by a loose attachment. Preferably the slots 78 are formed along the neutral axis or circle of the upper cone disk spring element to avoid movement of the cone disk spring element at the point of attachment during its flexure. (The neutral axis or circle is a point where the spring experiences little or no movement during its flexure.) To control the weight of the heel construction, the attachment ring is preferably formed of a light-weight structural material such as aluminum.

Figure 11A:
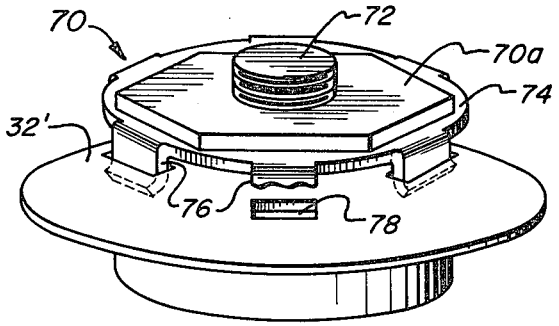
FIG. 11*a* is a perspective view of the attachment ring and main spring shown in FIG. 11.

As is best seen in FIG. 11*a*, the main horizontal member 70*a* of the attachment ring 70 has a hexagonal periphery. This configuration allows a tool such as a wrench to firmly engage the attachment ring to unscrew it from the sole for replacement. The hexagonal configuration and the wrench can, of course, also be used to tighten a replacement heel assembly onto the shoe.

Figure 12:
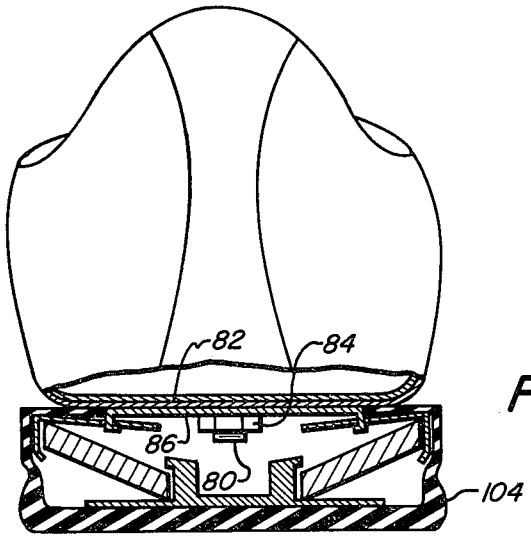
FIG. 12 is a view in vertical section of yet another embodiment of the invention suitable for competitive running shoes and utilizing a single coned disk main spring replaceably secured to the sole of the shoe.
Figure 13:
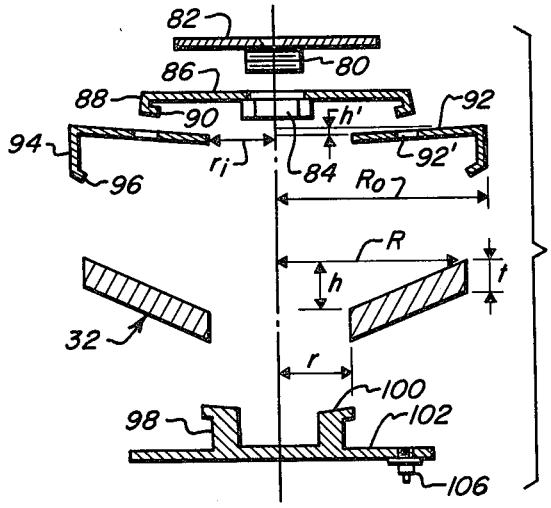
FIG. 13 is an exploded view in vertical section of the spring assembly shown in FIG. 12.
Figure 14:
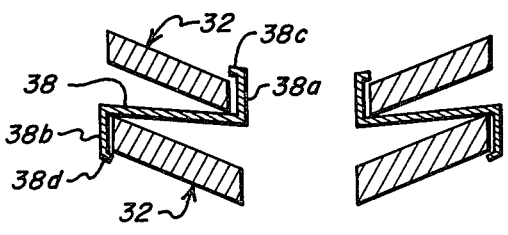
FIG. 14 is a view in vertical section of a double, cascaded coned disk main spring and a spring mounting bracket suitable for a jogging or training shoe.

FIGS. 12–14 disclose still further embodiments of the present invention utilizing coned disk spring elements to provide a large degree of vertical compliance and a high degree of resistance to lateral shear. These embodiments also include a mounting assembly which is replaceably threaded to the sole of the shoe and which engages the main spring 32. The mounting assembly includes a mounting stud 80 secured to a plate 82 that in turn is secured in the sole of the shoe. The plate 82 can lie at the bottom of the outer sole or be embedded in the sole. Because the stud 80 is secured to the plate 82, it forms a permanent part of the sole.

A nut 84 carrying an upper plate 86 threads onto the stud 80. Again, the sense of the thread is preferably one which automatically tightens the nut onto the stud during use. The upper plate 86 extends generally horizontally and has a downwardly projecting flange portion 88 and angularly spaced tabs 90 which function similarly to the tabs 76. Rather than engaging the main spring directly, however, the tabs 90 engage an upper mounting spring 92 having an aligned set of slots 92' formed in its horizontal surface. The moutning spring 92 also has a downwardly projecting flange 94 and an in-turned annular lip 96 whose dimensions are adapted to loosely hold the outer edge of the spring 32.

The upper horizontal surface of the mounting spring 92 has a slight conical configuration with its height designated in FIG. 13 by h'. The inner and lower edge of the main spring engages a recess 98 formed on the outer surface of an upstanding annular flange 100 secured to or formed integrally with a generally horizontal bottom plate 102. As shown in FIG. 12, this mounting assembly and main spring combination are enclosed in a heel-shaped shell 104 of a synthetic, highly wear resistant material which protects the working parts of the spring assembly from dirt, water, and other contaminants. FIG. 13 illustrates spikes 106 secured to the bottom plate 102. When used in conjunction with the shell 104, the spikes will penetrate preformed holes in the shell.

FIG. 14 discloses an alternative arrangement for use in the construction shown in FIGS. 12 and 13, but providing a double cascaded main spring with two spaced-apart and parallel cone disk spring members 32 mounted in and supported by the annular mounting bracket 38. Like the upper mounting spring 92, the bracket 38 is formed of a resilient structural material and has a generally conical configuration. The mounting spring 92 and bracket 38 therefore provide some spring action in addition to mounting the coned disk springs. It should be noted that the bracket 38 has an upstanding flange 38*a* and a downwardly projecting flange 38*b* located at its inner and outer edges, respectively. In-turned annular lips 38*c* and 38*d* hold the main springs on the bracket 38. It should also be noted that in the FIGS. 12–14 embodiments there is a slight clearance between the inner and outer edges of the main spring and the opposite wall of the associated support element, whether the recess 98 or one of the flanges 94, 38*a* or 38*b*. These clearances allow for the small lateral movement of the main spring 32 as it flexes.

By way of illustration but not of limitation, the main spring 32 shown in the FIGS. 12–14 embodiments is preferably formed of nylon or a fiber-reinforced plastic including cellulose acetate butyrate and preferably has a Young's modulus near 200,000 psi. The main spring 32 is formed by casting and machining. For the embodiment shown in FIGS. 12 and 13, which is suitable for a competitive racing shoe, the main spring formed of the foregoing materials preferably has a thickness t of approximately 0.190 inch, a height h of 0.333 inch, and outer radius R of 1.28 inch and an inner radius r of 0.51 inch. The spacing or clearance between the edges of the main spring and the mounting elements is preferably 0.052 inch. The upper mounting spring, which is preferably formed of steel or a steel alloy punched from a sheet and stamped into proper shape, preferably has a thickness t of 0.040 inch, a height h' of 0.045 inch, an outer radius $R_o$ of 1.3 inch, an inner radius $r_i$ of 0.52 inch. The mounting stud 80 and shoe plate 82 are preferably formed of nylon or a similar plastic material. The stud is preferably $\frac{3}{8}$ inch in diameter and approximately $\frac{3}{8}$ inch in length. The upper mounting plate 84 can be formed of nylon, steel, aluminum, or a suitable plastic material. The plate is preferably 0.10 inch in thickness the tabs 90 preferably engage the upper mounting spring 92 in slots 92' formed along the circular neutral axis of the upper mounting spring. The bottom plate is preferably formed of nylon, the material sold under the trade designation Teflon, or a plastic material exhibiting an equivalent structural strength and weight.

The heel construction described above has the following deflection characteristics when loaded. For the "single" spring embodiment of FIGS. 12 and 13, the total spring assembly has an undeflected height of 0.56 inch. At an applied peak running force for a typical male adult of approximately 414 lbf, the deflected or loaded height of the spring assembly is approximately 0.31 inch. The vertical compliance of this spring assembly, expressed as a spring constant, is approximately 20,000 lbf/ft. For the double spring embodiment shown in FIG. 14, the total undeflected height of the spring assembly is approximately 1.12 inch. At the same peak applied force, the deflected or fully loaded height of the assembly is 0.62 inch. The vertical compliance of the double spring heel construction is approximately 10,000 lbf/ft. These performance characteristics confirm that the single spring embodiment of FIGS. 12 and 13 is well suited to competitive running whereas the double spring embodiment is well suited for use as a training or jogging shoe. Also, it should be noted that these heel constructions exhibit a compression ratio that is almost exactly 2:1. As noted above, applicants are aware of no shoe construction which provides this degree of compression (and hence vertical compliance) while at the same time providing excellent resistance to lateral shear. It should also be noted that even utilizing the taller double spring embodiment, the overall height of approximately 1 and ⅛ inch allows for a ⅛ inch layer of a rubber tread or the bottom layer of the synthetic shell 104. The resulting structure has an undeflected thickness of 1 and ¼ inch, which is within acceptable comfort limits. For the racing heel construction, a tread having a ⅛ inch thickness results in a heel height of 0.65 inch, again, a height which is acceptable.

In addition to the natural tightening action induced by the twisting of the foot, it may be desirable to secure the heel assembly against rotation mechanically. A suitable arrangement can include a tab which projects laterally from the heel assembly and is secured to the outer sole by a small set screw. Also, the construction described with reference to FIGS. 12–14 can be made in a non-replaceable embodiment to reduce the weight of the heel construction and the overall height of the heel. The upper plate 86 can be secured to the outer sole permanently and the mounting stud 80 and mounting plate 82 and the nut 84 eliminated. Selection of materials having a low density will also help to control the weight.

FIG. 15 represents yet another heel construction 26 according to the invention utilizing a double coned disk spring 32 which itself forms the heel of a shoe. This construction is also replaceably mounted to the sole utilizing a mounting plate 110 having an upwardly directed, threaded, stud 112 centered on the plate. The stud 112 is secured to the sole of the shoe in the manner described hereinabove. The mounting plate preferably has a hexagonal periphery which like the FIG. 11 embodiment is adapted to engage a wrench to assist in securing and detaching the heel. The lower face of the mounting plate 110 carries a ball ring 112 which is secured to the plate 100 through an annular flange or rim 114. The plate 110, rim 114 and ring 112 are preferably formed as an integral structure. The upper coned disk member of the main spring 32 has formed on its upper surface, along its neutral axis, an annular socket adapted to engage the ball ring 112 in a snap fit. Because the resulting annular ball and socket joint is located on the neutral axis of the main spring 32, there is no lateral movement of the joint tending to disengage it. However, there is a small rotating movement which is accommodate by the ball and socket nature of the joint. A similar annular ball and socket joint 116 secures the lower coned disk element of the main spring 32 to a generally flat lower plate 118. A heel pad 40''' of a highly wear resistant material such as hard rubber is secured to the bottom surface of the plate 118.

The main spring 32 in this embodiment is shown as formed of two coned disk springs 32' and 32'' which are not integral or fused together at their outer peripheries as is the case in the embodiments discussed hereinabove. Rather, their outer edges **32*d* are generally cylindrical when the spring is in its undeflected position as shown in FIG. 15. A retaining ring 120 holds these opposed coned disk springs in operative engagement with one another at their outer edges. The retaining ring 120 is preferably split or expansible to accommodate the outward lateral movement of the outer edges of the springs during flexure. Preferably the retaining ring 120 is formed of nylon, the cone disk spring members are formed of fiber reinforced cast nylon and the mounting plate and lower plate are formed of aluminum or some other structural material exhibiting the requisite strength and weight characteristics. By way of illustration but not of limitation the heel construction 26 of FIG. 15 has an overall height, excluding the stud 112 and the lower pad 40''' of 1.0 inch, and the annular ball and socket joints are circular with a radius of approximately 1.50 inch. The stud 112** preferably has a height and a diameter of 0.25 inch.

The heel constructions 26 described above all provide what has heretofore been regarded as an enormous degree of vertical compliance at the heel area of a shoe while at the same time rendering the heel substantially resistant to lateral shear forces applied to the heel. The heel constructions of the present invention are also characterized by very high compression ratio, typically in the range of 2:1 and an extremely high degree of efficiency in returning energy to the person wearing the shoe. Depending on the materials and types of construction selected, energy return efficiencies of up to 95% to 98% are achievable.

With these operating characteristics, it is possible to design a shoe which is biomechanically tuned or optimal for a given person, a given type of shoe, and a wide variety of conditions of use. Thus, while the invention is principally designed for use in adult running shoes, whether competitive, training or jogging, its advantages can also be applied to children's running shoes and conventional shoes of all types. A particularly apt use is orthopedic shoes designed to minimize the stress applied to the bones or joints of the foot, ankle or leg. Orthopedic shoes according to this invention can aid individuals with arthritis of the joints of the leg or ankle or individuals who have sustained cartilage damage. The shoe construction of the present invention is also replaceable to change a worn heel or to vary the performance characteristics of the shoe. Thus, for example, a runner may secure a training heel to a shoe for training purposes but secure a different heel to the same shoe for competitive running events. Also, even where a competitive running event uses a tuned surface according to applicants' playing surface invention, the tuning is usually for a single value that accommodates a wide range of runners, types of running and running styles. By using shoes 24 according to the present invention, a competitive runner can fine tune the surface to his particular requirements. Also, for certain forms of exercising extremely large levels of compliance, beyond those readily attainable by "tuned" surfaces or tuned shoes alone, may be desirable. In such cases, these levels can be attained through the use of a shoe 24 according to this invention, in conjunction with a tuned athletic playing surface.

The present invention also offers many manufacturing advantages. It requires no redesign of the shoe upper. All of the advantages of the present invention can be accomplished through the use of a heel construction according to the present invention. Moreover, this heel construction utilizes known materials and techniques.

Finally, for high quality running shoes, the present invention offers significant improvements in several critical performance areas without detracting from the performance of the shoes in other areas. Rearfoot impact is markedly improved. Rearfoot control is also improved, in part because there is a minimal heel penetration (the impact of the shoe with the ground is absorbed by the heel of the shoe rather than by the heel of the foot being driven downwardly into the shoe). Rearfoot control is also greatly improved by the excellent lateral stability of the present invention. These improvements do not sacrifice other important qualities for a running shoe such as its weight, flexibility, or traction. Wear is also improved since the heel pads 40, 40', 40'', and 40''' can be replaced, or the entire heel construction can be replaced, when it or any of its components become worn without sacrificing the entire shoe.

While the invention has been described with respect to certain preferred embodiments, various modifications and variations are contemplated. For example, a parallel stack of coned disk springs can be used in place of a single coned disk spring. Also, while replaceable heels have been described at least in part as being secured by a threaded stud, other mechanical locking arrangements can be used. Other variations include the use of conventional coil springs rather than the soft rubber columns 50, 50'. Along this line, other materials can be used, particularly structural materials exhibiting enhanced strength and durability at a lower weight. These materials, however, are usually more expensive. For example, where metallic components are described it is possible to use more sophisticated, lighter weight materials or materials having better performance in other areas such as wear or fatigue resistance.

These and various other modifications and variations of the invention will become apparent to those skilled in the art from the foregoing detailed description and the accompanying drawings. Such modifications and variations are intended to fall within the scope of the appended claims.

What is claimed and desired to be secured by Letters Patent is:

1. A shoe that is biomechanically tuned for an optimal response for the person wearing the shoe and a selected use of the shoe has an upper and a sole that each extend in a generally horizontal direction and includes a heel construction comprising a main spring formed of a resilient material, said main spring being structured to flex repeatedly in a generally vertical direction transverse to said horizontal direction over a relatively small maximum vertical displacement while providing a high degree of vertical compliance during each complete loading cycle associated with said use and also structured to provide a high degree of resistance to lateral shear, said main spring being structured to transiently store the impact force on said heel construction during each said vertical flexure and then returning said transiently stored energy to the person with a high level of efficiency.

2. A shoe according to claim 1 wherein said main spring is constructed to flex through a combination of localized stretching and compression.

3. A shoe according to claim 2 wherein said main spring comprises at least one coned disk spring.

4. A shoe according to claims 2 or 3 wherein said vertical compliance is in the range of 3,000 to 25,000 lbf/ft where said compliance is expressed in terms of its inverse, a spring constant.

5. A shoe according to claim 2 wherein said main spring deflects a maximum distance in said vertical direction during running in the range of $\frac{1}{8}$ inch to $\frac{5}{8}$ inch.

6. A shoe according to claim 3 wherein said main spring comprises at least two of said coned disk springs vertically stacked and operatively coupled to one another.

7. A shoe according to claim 6 wherein said vertical stacking is series.

8. A shoe according to claim 3 wherein said main spring is formed of a plastic.

9. A shoe according to claim 8 wherein said plastic is nylon.

10. A shoe according to claim 1 wherein said main spring has a compression ratio in said vertical direction of approximately 2:1 at the time of a peak applied vertical force.

11. A shoe according to claim 3 wherein said at least one coned disk spring occupies at least half the volume of said heel construction.

12. A shoe construction according to claim 11 wherein said at least one coned disk spring defines the outer shape of said heel construction.

13. A shoe construction according to claim 1 wherein said vertical compliance of said heel construction is substantially area independent.

14. A shoe that is biomechanically tuned for an optimal response for the person wearing the shoe and a selected use of the shoe has an upper and a sole that each extend in a generally horizontal direction and includes a heel construction comprising a main spring formed of a resilient structural material and characterized by a coned disk configuration that is an exoskeleton for said heel to provide substantially all of the structural rigidity of said heel, said main spring being structured to flex repeatedly with a high degree of compliance during each complete loading cycle associated with said use in a vertical direction transverse to said horizontal direction over a relatively small maximum vertical displacement while providing a high degree of resistance to lateral shear, said main spring being structured to transiently store the impact force on said heel construction during each said vertical flexure of and then returning said transiently stored energy to the person with a high degree of efficiency.

15. A shoe according to claim 14 wherein the axis of symmetry of said coned disk configuration is oriented generally along said vertical direction.

16. A shoe according to claim 15 wherein said main spring comprises a vertical stack of at least two coned disk springs that are operatively coupled to one another.

17. A shoe according to claim 16 wherein said vertical stacking is series.

18. A shoe construction according to claim 16 wherein at least two of said coned disk springs are coupled at their large diameter peripheries to form an enclosed air chamber.

19. A shoe according to claim 18 further comprising means for adjusting the air pressure within said chamber.

20. A shoe that is biomechanically tuned for an optimal response for the person wearing the shoe and a selected use of the shoe has an upper and a sole that each extend in a generally horizontal direction and includes a heel construction comprising a main spring formed of a resilient structural material and characterized by a coned disk configuration that acts as an exoskeleton for said heel to provide substantially all of the structural rigidity of said heel, said main spring being structured to flex repeatedly with a high degree of compliance in a vertical direction transverse to said horizontal direction over a relatively small maximum vertical displacement while providing a high degree of resistance to lateral shear, said main spring being structured to transiently store the impact force on said heel construction during each said vertical flexure and then returning said transiently stored energy to the person with a high level of efficiency.

21. A shoe according to claim 20 wherein said securing means comprises a resilient material configured and positioned to form said heel, said resilient material embedding said main spring and being secured to said outer sole.

22. A shoe construction according to claim 20 wherein said securing means is replaceable.

23. A shoe according to claim 22 wherein said replacement securing means comprises a screw means.

24. A shoe according to claim 23 wherein said screw means is threaded to tighten automatically due to a natural twisting movement of the foot during walking or running.

25. A shoe according to claim 23 further comprising means for selectively securing said screw means against rotation.

26. A shoe according to claim 23 wherein said screw means comprises a vertically projecting flange secured to said main spring and having a thread formed on its outer surface and mating thread means formed in said sole.

27. A shoe according to claim 26 wherein said mating thread means comprises an annular recess formed in the bottom surface of said sole with a thread formed on its inwardly facing wall.

28. A shoe according to claim 23 wherein said screw means comprises a downwardly projecting, threaded mounting stud secured to said sole and a spring mounting plate that includes a nut that threads on said stud.

29. A shoe according to claim 28 wherein said mounting plate has a downwardly projecting peripheral flange portion.

30. A shoe according to claim 29 wherein said flange portion engages said main spring.

31. A shoe according to claim 29 further comprising an upper spring member adapted to engage said coned disk spring at its outer periphery and also having means for engaging said peripheral flange portion of said mounting plate.

32. A shoe according to claim 29 wherein said main spring comprises at least two vertically spaced, axially aligned coned disk springs in parallel relation, and wherein said securing means includes annular bracket means disposed between said coned disk springs that holds said springs in said spaced, aligned relationship.

33. A shoe according to claim 23 wherein said screw means includes a mounting plate intermediate said main spring and said sole, said mounting plate having a polygonal periphery.

34. A shoe according to claim 28 wherein said mounting plate is secured to said coned disk main spring by an annular ball and socket joint.

35. A shoe according to claim 30 wherein said mounting plate engages said coned disk main spring at its neutral axis.

36. A shoe that is biomechanically tuned for an optimal response for the person wearing the shoe and a selected use of the shoe has an upper and a sole that each extend in a generally horizontal direction and includes a heel construction comprising an integral main spring formed of a resilient structural material and characterized by a coned disk configuration that is an exoskeleton for said heel to provide substantially all of the structural rigidity of said heel, said main spring being structured to flex repeatedly with a high degree of compliance during each complete loading cycle associated with said use in a vertical direction transverse to said horizontal direction over a relatively small maximum vertical displacement while providing a high degree of resistance to lateral shear, said main spring being structured to transiently store the impact force on said heel construction during each said vertical flexure and then returning said transiently stored energy to the person with a high level of efficiency, and a resilient member positioned at said heel and structured to complement the load deflection characteristics of said main spring.

37. A shoe according to claim 36 wherein said resilient member provides a generally linear force deflection characteristic for said heel at force and deflection levels where the cone disk spring member alone would buckle.

38. A shoe according to claim 36 wherein said resilient member is resilient material.

39. A shoe according to claim 38 wherein said resilient material is foamed rubber.

40. A shoe according to claim 38 wherein said material is a foamed plastic.

41. A shoe according to claim 38 wherein said main spring is embedded in said resilient material.

42. A shoe according to claim 38 wherein said resilient material is disposed within said main spring.

43. A shoe according to claim 36 wherein said resilient member is a coil spring.

44. A shoe according to claim 36 wherein said resilient member is a column of a highly resilient material located generally at the center of said cone disk spring.

45. A shoe according to claim 44 wherein said highly resilient material is a soft rubber.

46. A shoe according to claim 36 wherein approximately half of the vertical compliance of said heel is attributable to said cone disk member at approximately half of the vertical compliance of said heel is attributable to said column of said resilient member.

47. A shoe according to claim 36 wherein said resilient member comprises an enclosed air chamber.

48. A shoe according to claim 47 wherein said main spring comprises at least in part an opposed pair of vertical series stacked coned disk springs that define, at least in part, said enclosed air chamber.

49. A shoe that is biomechanically tuned for an optimal response for the person wearing the shoe and a selected use of the shoe has an upper and a sole that each extends in a generally horizontal direction and include a heel construction comprising an integral main spring formed of a resilient structural material and characterized by a coned disk configuration that is an exoskeleton for said heel to provide substantially all of the structural rigidity of said heel, said main spring being structured to flex repeatedly with a high degree of compliance during each complete loading cycle associated with said use in a vertical direction transverse to said horizontal direction over a relatively small maximum vertical displacement while providing a high degree of resistance to lateral shear, said main spring being structured to transiently store the impact force on said heel construction during each said vertical flexure and then returning said transiently stored energy to the person with a high level of efficiency, a resilient member positioned at said heel and structured to complement the load deflection characteristics of said main spring, and means for securing said heel construction to said sole.

50. A shoe according to claim 49 wherein said resilient member comprises a resilient material that embeds said main spring.

51. A shoe according to claim 49 wherein said securing means is replaceable.

52. A shoe according to claim 51 wherein said securing means comprises screw means.

53. A shoe according to claim 52 wherein said resilient member comprises a column of a highly resilient material located generally at the center of said main spring.

54. A shoe according to claim 51 wherein said securing means includes a mounting assembly disposed between said main spring and said sole.

55. A shoe construction according to claim 49 wherein said vertical compliance is in the range of 3,000 to 25,000 lbf/ft where said compliance is expressed in terms of its inverse, a spring constant.

56. A shoe construction according to claim 49 wherein said main spring is formed of plastic.

57. A shoe according to claim 49 wherein said main spring has a compression ratio in said vertical direction of approximately 2:1 at the time of a peak applied vertical force.

58. A shoe construction according to claim 49 wherein said main spring occupies at least half the volume of said heel construction.

59. A shoe according to claim 49 wherein said vertical compliance of said heel construction is substantially area independent.

* * * * *